US007191550B2

(12) United States Patent
Baek

(10) Patent No.: US 7,191,550 B2
(45) Date of Patent: *Mar. 20, 2007

(54) SKATEBOARD SHOE WITH SOLE OF VARYING HARDNESS

(75) Inventor: Jai K. Baek, San Diego, CA (US)

(73) Assignee: DC Shoes, Inc., Vista, CA (US)

( * ) Notice: Subject to any disclaimer, the term of this patent is extended or adjusted under 35 U.S.C. 154(b) by 54 days.

This patent is subject to a terminal disclaimer.

(21) Appl. No.: 11/208,139

(22) Filed: Aug. 19, 2005

(65) Prior Publication Data

US 2005/0274044 A1 Dec. 15, 2005

Related U.S. Application Data

(63) Continuation of application No. 10/125,827, filed on Apr. 18, 2002, now Pat. No. 6,931,768.

(51) Int. Cl.
*A43B 3/00* (2006.01)
*A43B 13/00* (2006.01)

(52) U.S. Cl. ..... 36/113; 36/115; 36/59 C

(58) Field of Classification Search ..... 36/59 C, 36/113, 115, 25 R, 31
See application file for complete search history.

(56) References Cited

U.S. PATENT DOCUMENTS 4,307,521 A * 12/1981 Inohara et al. ..... 36/31
4,574,497 A 3/1986 Jindra ..... 36/77
5,024,007 A * 6/1991 DuFour ..... 36/127
5,319,866 A 6/1994 Foley et al. ..... 36/91
5,465,507 A 11/1995 Schumacher et al. ..... 36/30
5,595,002 A 1/1997 Slepian et al. ..... 36/27
5,862,614 A 1/1999 Koh ..... 36/31
5,926,974 A * 7/1999 Friton ..... 36/28
6,021,588 A 2/2000 Alviso ..... 36/102
6,038,790 A 3/2000 Pyle et al. ..... 36/30
6,076,283 A * 6/2000 Boie ..... 36/59 C
6,108,943 A * 8/2000 Hudson et al. ..... 36/102
6,119,373 A * 9/2000 Gebhard et al. ..... 36/114
6,266,897 B1 * 7/2001 Seydel et al. ..... 36/29

FOREIGN PATENT DOCUMENTS

| | | | |
|---|---|---|---|
| DE | 3035706 | | 6/1982 |
| DE | 3804441 | | 8/1989 |
| EP | 0925000 | | 6/2002 |
| JP | 2159201 | * | 6/1990 |
| JP | 5329005 | * | 12/1993 |

* cited by examiner

*Primary Examiner*—Marie Patterson
(74) *Attorney, Agent, or Firm*—Snell & Wilmer LLP

(57) ABSTRACT

A skateboard shoe having a sole with four sole pads; each sole pad having differing durometer values: a lateral pad and a toe pad comprised of a low durometer value (Shore A) material, a medial pad comprised of a moderate durometer value (Shore A) material, and a heel pad comprised of a hard durometer value (Shore A) material.

6 Claims, 2 Drawing Sheets

SKATEBOARD SHOE WITH SOLE OF VARYING HARDNESS

This application is a continuation of U.S. application Ser. No. 10/125,827 filed Apr. 18, 2002, now U.S. Pat. No. 6,931,768.

FIELD OF THE INVENTION

The devices and methods described below relate to skateboarding shoes and particularly to the design of the sole of skateboarding shoes.

BACKGROUND OF THE INVENTIONS

A skateboard is controlled primarily through the rider's feet. Greater control of a skateboard may be provided by appropriate footwear and allow the rider to perform more skateboard tricks, such as ollies, kickflips, and crooks, with a greater degree of mastery. Any shoe designed for use during skateboarding should be designed to appropriately transmit forces between the rider's foot and the skateboard. In other words, the shoe should be designed to account for the required force transfer used by a skateboard rider to control the skateboard. In addition, the shoe should be designed to provide the rider with a better grip of the skateboard. In particular, the shoe should provide a better grip in the ollie area of the shoe. The skateboard shoes described below provide a structure which provides an appropriate grip between the shoe and a skateboard and facilitates appropriate force transfer between the skateboard and a rider.

SUMMARY

The shoes described below provide for improved force transfer during skateboarding. The sole of the shoe comprises three pads where the shoe contacts a skateboard. The sole area corresponding to the outside front of the foot is made from a low durometer material that aids in gripping the skateboard. The sole area corresponding to the inside front of the foot (the ball of the foot) is made from a moderate durometer material that provides both gripping ability and durability. The sole area corresponding to the heel of the foot is made from a high durometer material to enhance direct force transfer and to provide high wear resistance.

DETAILED DESCRIPTION OF THE INVENTION

Figure 1:
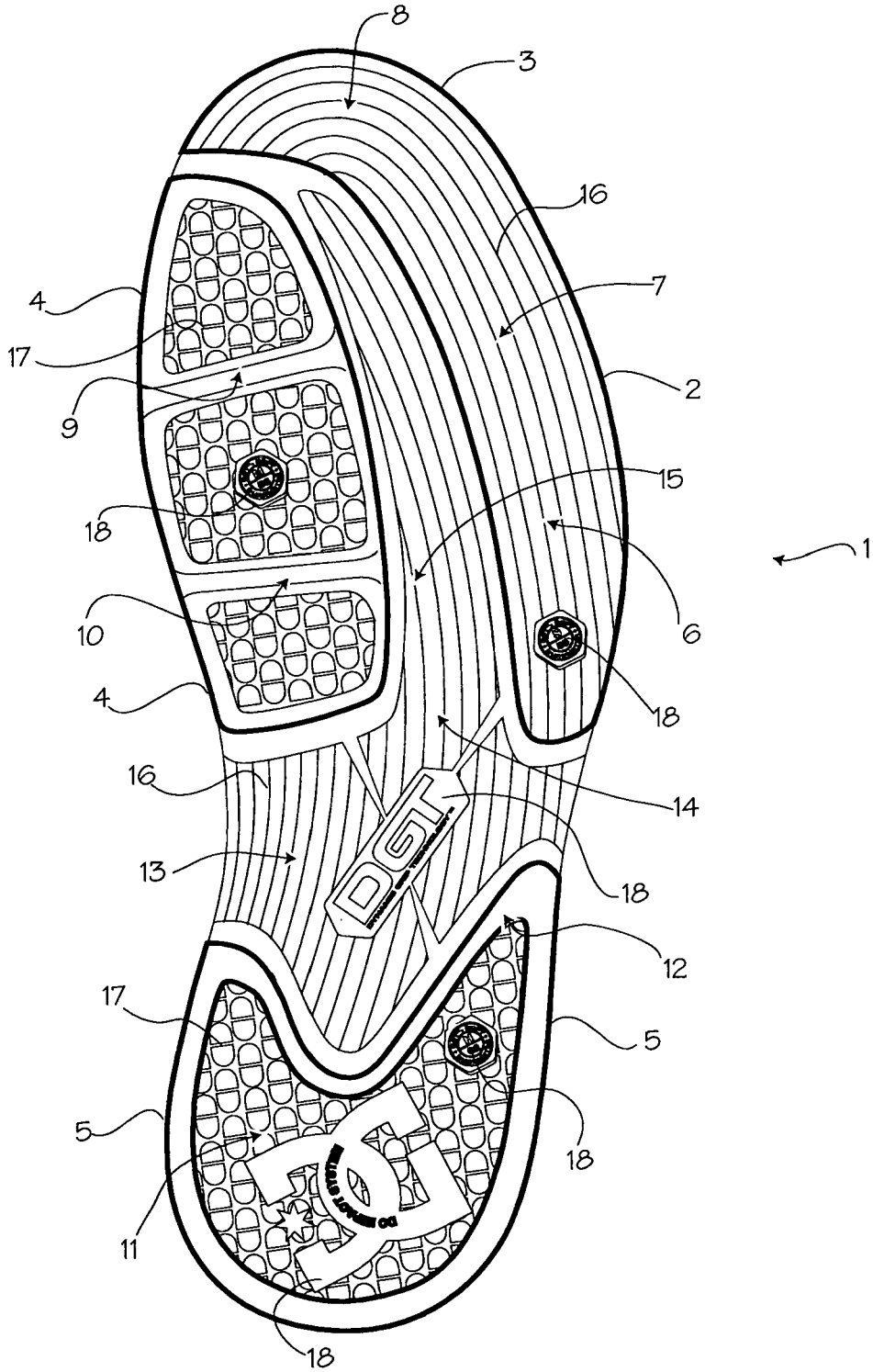
FIG. 1 shows the sole of a skateboarding shoe.

FIG. 1 shows the sole 1 of a skateboarding shoe. The sole comprises a lateral pad 2, a toe pad 3, a medial pad 4, and a heel pad 5. These pads are provided in materials having differing hardness in order to promote the forces applied by skateboarders to the skateboard during use.

The lateral pad 2 and toe pad 3 have a durometer value in the range of about 53 Shore A to about 57 Shore A. The lateral pad 2 and toe pad 3 may be made of many compounds of appropriate hardness, and a suitable compound comprises 29.5% standard Malaysian rubber, 35.4% butadiene rubber (polybutadiene rubber or high-cis polybutadiene rubber such as BR01™ or Taktene™), 3.9% butyl rubber, 25.5% silica (such as Zeosil™, or other dispersing agent), 4.9% plasticizer (such as paraffinic process oil (P Oil) or naphthenic process oil) and 0.8% coupling agent (such as Silane or any other chemical used to adjust the curing properties of the rubber). The pads may comprise different weights of the same materials, or may comprise similar materials, though the pads should have a relatively soft durometer value.

The lateral pad is disposed generally on the lateral side of the sole and the toe pad is disposed generally in the forefoot region of the sole. The two areas are referred to as the ollie area by skateboarders, because it is the area of the shoe to perform an ollie. The lateral pad may be integrally formed with the toe pad. As an integral whole, the lateral pad 2 and the toe pad 3 are located on the anterior portion of the lateral midfoot 6, the lateral portion of the forefoot 7, and the anterior portion of the forefoot 8.

The lateral pad may also be treated or coated with substances to provide a moderate degree of tackiness. In one embodiment butyl rubber provides the required tackiness. The relative softness (and tackiness, if enhanced) of the lateral pad enhances the friction, or "grip," between the pad and the shoe during all maneuvers in which the skateboarder attempts to apply lateral force to the board with a swiping or lateral movement of the foot across the board.

The medial pad 4 has a durometer value in the range of about 56 Shore A to about 60 Shore A. The medial pad may be made of many compounds of appropriate hardness, and a suitable compound comprises 19.3% standard Malaysian rubber, 38.5% butadiene rubber (polybutadiene rubber or high-cis polybutadiene rubber such as BR01™ or Taktene™), 9.6% nitrile butadiene rubber, 27.0% silica (such as Zeosil™, other dispersing agent), 4.8% plasticizer (such as paraffinic process oil (P Oil) or naphthenic process oil), and 0.8% coupling agent (such as Silane or any other chemical used to adjust the curing properties of the rubber). The pad may comprise different weights of the same materials, or may comprise similar materials, though the pad should have a relatively moderate durometer value as compared to the lateral pad and the heel pad. In the embodiment shown in FIG. 1, the medial pad 4 is located in the area of the sole corresponding to the ball of the foot (the medial portion of the forefoot 9) and the anterior portion of the medial midfoot 10.

The heel pad 5 has a durometer value in the range of about 60 Shore A to about 64 Shore A. The heel pad 5 may be made of many compounds of appropriate hardness, and a suitable compound comprises 19.1% standard Malaysian rubber, 38.2% butadiene rubber (polybutadiene rubber or high-cis polybutadiene rubber such as BR01™ or Taktene™), 9.5% nitrile butadiene rubber, 28.6% silica (such as Zeosil™, or other dispersing agent), 3.8% plasticizer (such as paraffinic process oil (P Oil) or naphthenic process oil) and 0.8% coupling agent (such as Silane or any other chemical used to adjust the curing properties of the rubber). The pad may comprise different weights of the same materials, or may comprise similar materials, though the pad should have a relatively hard durometer value.

The heel pad is located in the area of the sole corresponding to the heel 11. However, the heel pad 5 can also extend somewhat into the midfoot region as shown in FIG. 1 (where the heel extends into the posterior portion of the lateral midfoot 12). The heel pad may also be referred to as the heel if provided in a discrete form. The relative hardness of the heel pad promotes efficient application of downward force on the skateboard during maneuvers in which the skateboarder must assert downward force.

With this construction of sole, the heel pad is harder than the medial pad, and the medial pad is harder than the lateral pad or toe pad. However, the toe pad and lateral pad typically have the same durometer value. The remaining portion of the outsole that is not covered by the pads 2, 3, 4, and 5, located in the arch area 13 (the area of the sole under the arch of foot when the shoe is worn), shank area 14, and midfoot area 15, may be made of any suitable material, such as phylon or molded ethyl vinyl acetate. The arch and midfoot region of the outsole may be integrally formed with the midsole of the shoe, and may be referred to as an exposed area of the midsole even though it functions as the outsole.

Each pad may have an embossed or raised tread pattern. In the embodiment shown in FIG. 1 the lateral pad 2 and toe pad 3 tread pattern comprises a series of contour lines 16. The medial pad 4 and heel pad 5 tread patterns comprise a series of raised treads 17. The particular shape of the treads illustrated in this drawing is a trademark of DC Shoes, Inc., though any other tread pattern may be used. Other trademarks 18 may be applied at various positions on the sole.

Figure 2:
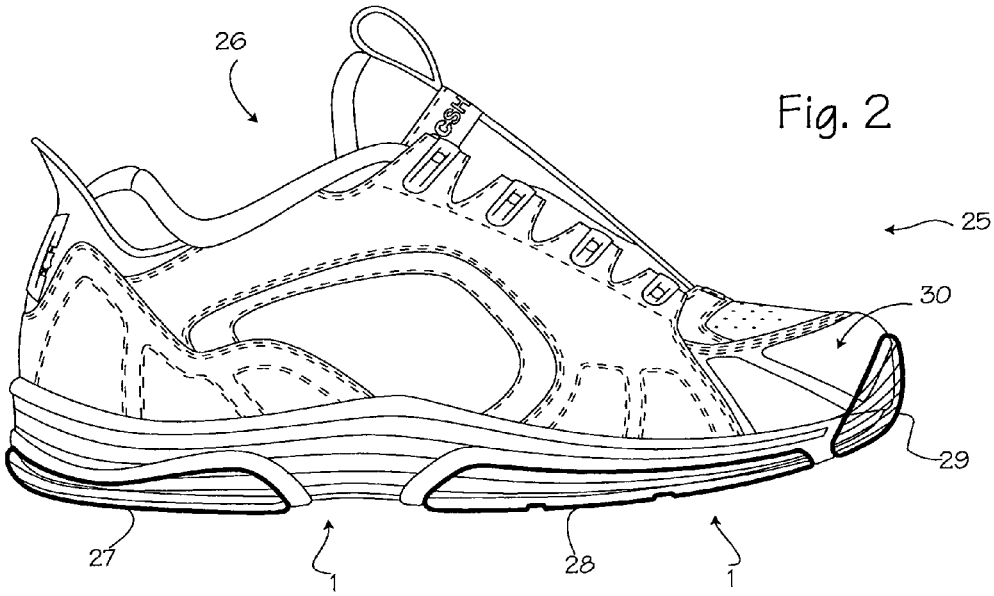
FIG. 2 shows the medial side of a skateboarding shoe.

FIG. 2 shows the medial side of a skateboarding shoe 25 with the sole 1 attached to the shoe upper 26. Disposed on the medial side of the shoe are a medial heel side pad 27, a medial side pad 28, and a toebox pad 29. The medial heel side pad 27 comprises materials similar to those materials that comprise the heel pad 5. The medial heel side pad has a durometer value in the range of about 60 Shore A to about 64 Shore A. The medial side pad 28 comprises materials similar to those that comprise the medial pad 4. The medial side pad has a durometer value in the range of about 56 Shore A to about 60 Shore A. The toebox pad 29 comprises materials similar to those materials that comprise the lateral pad 2 and toe pad 3. The toebox pad has a durometer value in the range of about 53 Shore A to about 57 Shore A. The medial heel side pad, medial side pad, and toebox pad allow the skateboard rider to use the toes and the inside edge of the foot to more effectively control the skateboard.

The medial heel side pad 27 and the medial pad 28 may cover a larger area and thus cover part of the upper 26. Likewise, the toebox pad 29 may cover a larger portion of the toebox 30. The toe pad 3 may be integrally formed with the toe box pad 29, the medial pad 4 may be integrally formed with the medial side pad 28, and the heel pad 5 may be integrally formed with the medial heel side pad 27. Thus, the medial heel side pad 27 may form an upwardly extending extension of the heel pad 5. Similarly, medial side pad 28 may form an upwardly extending extension of the medial pad 4, and the toe box pad 29 may form an upwardly extending extension of the toe pad 3.

Figure 3:
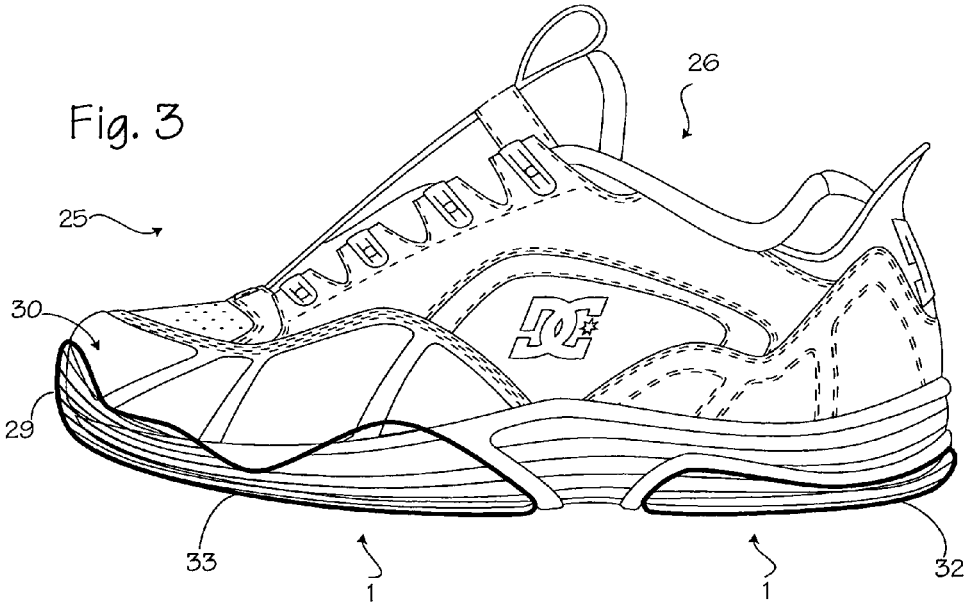
FIG. 3 shows the lateral side of the skateboarding shoe shown in FIG. 2.

FIG. 3 shows the lateral side of a skateboarding shoe 25. Disposed on the lateral side of the shoe are a lateral heel side pad 32, a lateral side pad 33, and the toebox pad 29. The lateral side heel pad 32 comprises materials similar to those materials that comprise the heel pad 5. The lateral heel side pad has a durometer value in the range of about 60 Shore A to about 64 Shore A. The lateral side pad 33 comprises materials similar to those materials that comprise the lateral 2 pad and the toe pad 3. The lateral side pad 33 has a durometer value in the range of about 53 Shore A to about 57 Shore A.

The lateral heel side pad 32 and the lateral side pad 33 may cover a larger area and thus cover more of the upper 26. The toebox pad 29 may cover a larger portion of the toebox 30. The lateral pad 2, the lateral side pad 33, and the toe box pad 29 may be integrally formed with each other. Likewise, the heel pad 5 and the lateral heel side pad 32 may be integrally formed with each other. Thus, the lateral heel side pad 32 may form an upwardly extending extension of the heel pad 5. Likewise, lateral side pad 33 and the toebox pad 29 may form upwardly extending extensions of the lateral pad 2 or the toe pad 3.

Together, the heel pad 5, the medial heel side pad 27, and lateral heel side pad 32 may form an integral heel pad. The integral heel pad may be disposed on the portions of the of the shoe corresponding to the medial side of the heel, the lateral side of the heel, the counter portion of the heel, and the portion of the sole corresponding to the plantar portion of the heel. Likewise, the lateral pad 2, the toe pad 3, the lateral side pad 33, and toebox pad 29 may form an integral ollie pad. The integral ollie pad may be disposed on the portions of the shoe corresponding to the toe box, the lateral side of the shoe, and the portions of the sole corresponding to the plantar portion of the toes and the plantar portion of the lateral side of the foot.

In use, the shoes constructed as described will be worn by a skateboarder while skateboarding. For maneuvers which require application of downward force to the skateboard, the rider will apply force in the customary fashion, by stomping on the board with the heel or other parts of the foot, but such forces will be applied more efficiently than they would with typical athletic shoes. For maneuvers which require application of lateral forces on the skateboard, the rider will apply force in the lateral direction in the customary manner, by swiping the board with the outer or inner edge of the shoes, but the swiping force will be more efficiently transferred to the skateboard vis-à-vis the same action with typical athletic shoes. Thus, the rider will have more control over the skateboard and will be better able to perform tricks and maneuvers.

The skateboard shoe described above can be made with many modifications from the materials and specific construction shown in the illustrations. Many elastomers and plastics can be used in place of the materials mentioned, which are merely the currently preferred materials. The specific structure of the pads may be varied while providing substantial coverage of the corresponding areas with the desired hardness and interoperability with the rider and skateboard. The pads need not be discrete, and may be co-molded or integrally formed as a single piece with areas of differing hardness corresponding to the illustrated pads, and they may be co-molded or integrally formed with the midsole or other components of the shoe. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A shoe comprising:

an upper having a toe box; and an outer sole disposed below the upper having the toe box, wherein the outer sole comprises:

a lateral side pad disposed in an area of the outer sole corresponding to the lateral side portion of the outer sole;

a medial side pad disposed in an area of the outer sole corresponding to the medial side portion of the outer sole;

a lateral heel side pad disposed in an area of the outer sole corresponding to the lateral side portion of the heel;

a medial heel side pad disposed in an area of the outer sole corresponding to the medial side portion of the heel; and a toe box pad disposed in an area of the outer sole corresponding to the toe box;

wherein the lateral side pad has a durometer value of about 53 Shore A to about 57 Shore A;

wherein the medial side pad has a durometer value of about 56 Shore A to about 60 Shore A;

wherein the lateral heel side pad has a durometer value of about 60 shore A to about 64 Shore A;

wherein the medial heel side pad has a durometer value of about 60 Shore A to about 64 Shore A;

wherein the toe box pad has a durometer value of about 53 Shore A to about 57 Shore A.

2. The shoe of claim 1 wherein the lateral side pad further comprises an embossed pattern.

3. The shoe of claim 1 wherein the medial side pad further comprises an embossed pattern.

4. The shoe of claim 1 wherein the lateral heel side pad further comprises an embossed pattern.

5. The shoe of claim 1 wherein the medial heel pad further comprises an embossed pattern.

6. The shoe of claim 1 wherein the toe box pad further comprises an embossed pattern.

* * * * *